US005117523A

United States Patent [19]

Jacobus et al.

[11] Patent Number: 5,117,523

[45] Date of Patent: Jun. 2, 1992

[54] HIGH SIDE REFRIGERATION SYSTEM MOUNTING ARRANGEMENT

[75] Inventors: Dwight W. Jacobus; John J. Domagala; Norbert P. Haag, all of Louisville, Ky.

[73] Assignee: General Electric Company, Louisville, Ky.

[21] Appl. No.: 617,689

[22] Filed: Nov. 26, 1990

[51] Int. Cl.[5] ..... F25D 23/12

[52] U.S. Cl. ..... 62/259.1; 62/291; 62/428; 62/507

[58] Field of Search ..... 62/295, 291, 428, 507, 62/508, 259.1

[56] References Cited

U.S. PATENT DOCUMENTS

| | | | |
|---|---|---|---|
| 2,685,178 | 8/1954 | Eck | 62/295 |
| 4,156,352 | 5/1979 | Gelbard et al. | 62/295 X |
| 4,490,992 | 1/1985 | Chastine | 62/295 |
| 4,497,183 | 2/1985 | Gelbard et al. | 62/295 |
| 4,555,915 | 12/1989 | Dasher | 62/428 X |

*Primary Examiner*—William E. Tapolcai

*Attorney, Agent, or Firm*—Radford M. Reams; H. Neil Houser

[57] ABSTRACT

A refrigerator includes a cabinet having an upper compartment to be refrigerated and a lower machinery compartment. First and second elongated support members extend across the front and back of the machinery compartment respectively. A condenser is supported from the first support member and extends rearwardly in the machinery compartment. A support frame is supported from the second support member and extends forwardly in the machinery compartment in partial overlapping relationship with the condenser. The overlapping portions of the condenser and frame are structurally connected. A compressor is mounted on the frame. A condensate collection container is supported from the rear support member and extends forwardly in the machinery compartment in partial overlapping relationship with the condenser. The overlapping portions of the condenser and container are structurally connected. A blower mechanism, including a shroud, is positioned in the machinery compartment with the shroud received in slots in the container and structurally connected to the cabinet.

10 Claims, 3 Drawing Sheets

HIGH SIDE REFRIGERATION SYSTEM MOUNTING ARRANGEMENT

BACKGROUND OF THE INVENTION

The present invention relates to refrigerators and, more particularly to the high side assembly housed in the machinery compartment of household refrigerators.

In many modern day refrigerators the condenser and the motor-compressor (collectively called the high side) are mounted in a machinery compartment. Often this compartment is formed in the lower portion of the cabinet. Also, often a pan or similar container is mounted in this compartment of self-defrosting refrigerators to collect condensate that results from defrosting the evaporator. Typically a fan or blower is mounted in this compartment to cause cooling air to flow over the condenser and compressor and to assist in evaporating the condensate in the container. It is common practice to independently mount the various operative components from the base frame of the refrigerator. However, the mounting hardware adds to the complexity of the machinery compartment, which adds cost and, at least to a degree, interferes with efficient air flow.

It is an object of this invention to provide an improved high side assembly and mounting arrangement.

It is another object to provide such an arrangement in which operating components are structurally connected.

It is yet another object to provide such a mounting arrangement in which certain operating components are interconnected to directly mount the overall assembly.

SUMMARY OF THE INVENTION

In accordance with one form of the present invention there is provided a refrigerator with an upper compartment to be refrigerated and a lower machinery compartment. First and second support members extend across the machinery compartment in spaced apart relationship. A condenser is supported from the first support member and a mounting structure is supported from the second support member. Means remote from the support members structurally connects the condenser and the mounting structure. A compressor is mounted on the mounting structure and a blower mechanism is positioned in the machinery compartment to cause air to flow across the condenser and compressor.

In another aspect of this invention a condensate collection container is supported from the second support member and means remote from the support members connects the condenser and the container.

In yet another aspect of this invention a blower mechanism, including a shroud, is positioned in the machinery compartment with the shroud received in elongated slots in the condensate collection container and structurally connected to the cabinet.

DESCRIPTION OF THE PREFERRED EMBODIMENTS

Figure 1:
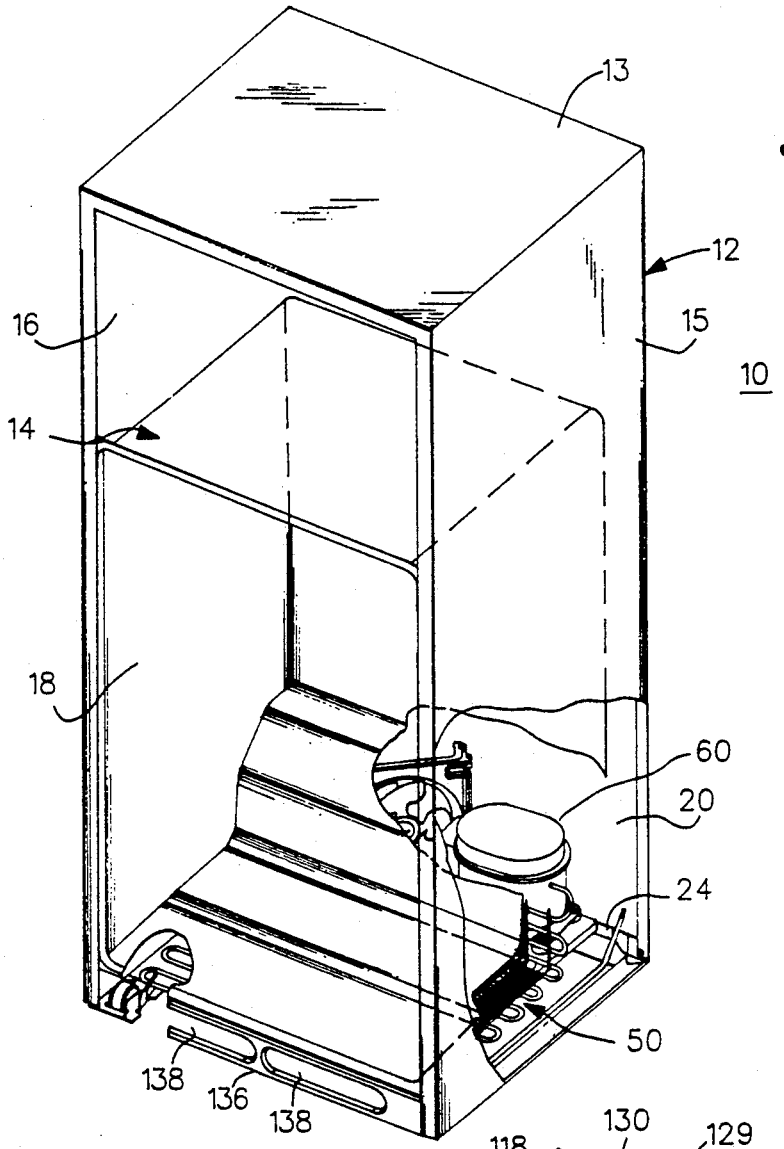
FIG. 1 is a front perspective view of a refrigerator incorporating one embodiment of the present invention, the view being somewhat schematic in form and with a number of components omitted for ease of understanding.

Referring to the accompanying drawings and particularly to FIG. 1, there is shown in somewhat simplified schematic form a household refrigerator 10 having a cabinet including an outer case 12 made of some suitable structural material such as steel and an inner liner 14. The cabinet defines upper compartments to be refrigerated, typically a freezer 16 and a fresh food compartment 18, is well as a lower machinery compartment 20. Normally insulation 19 is placed between the outer case and the liner so as to surround the freezer and fresh food compartment (see FIG. 4) The outer case normally includes a top wall 13 and a pair of descending side walls 15 and 17.

Figure 4:
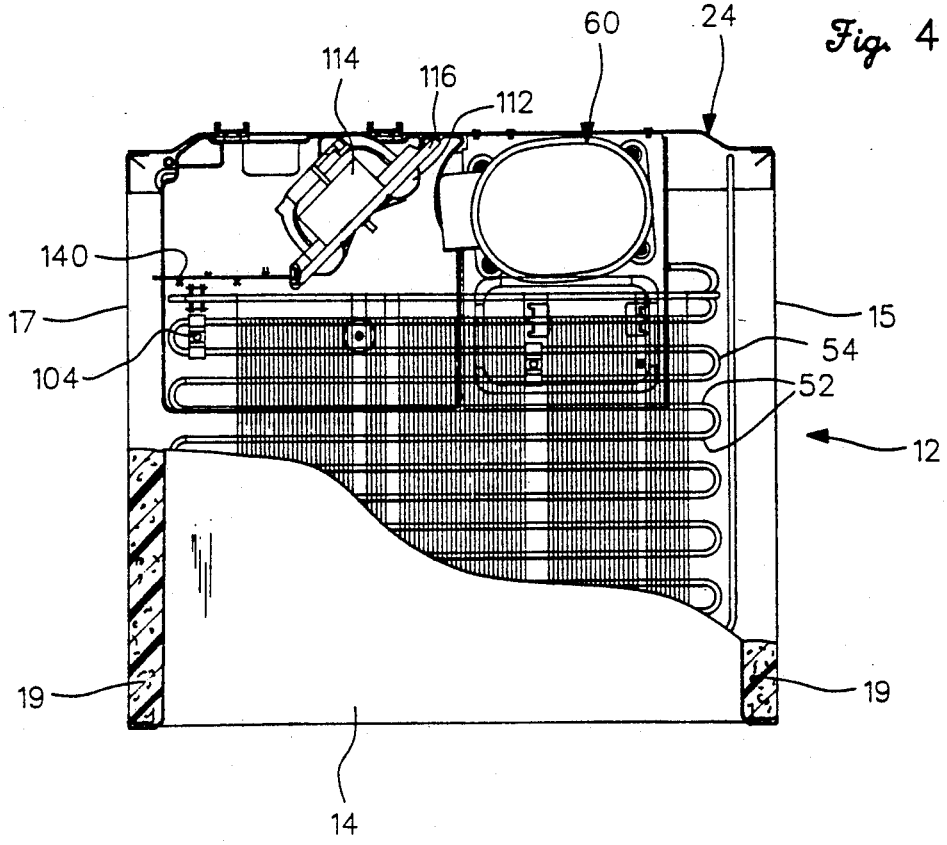
FIG. 4 is a cross-sectional view of the refrigerator of FIG. 1, illustrating certain details of the high side equipment assembly.
Figure 5:
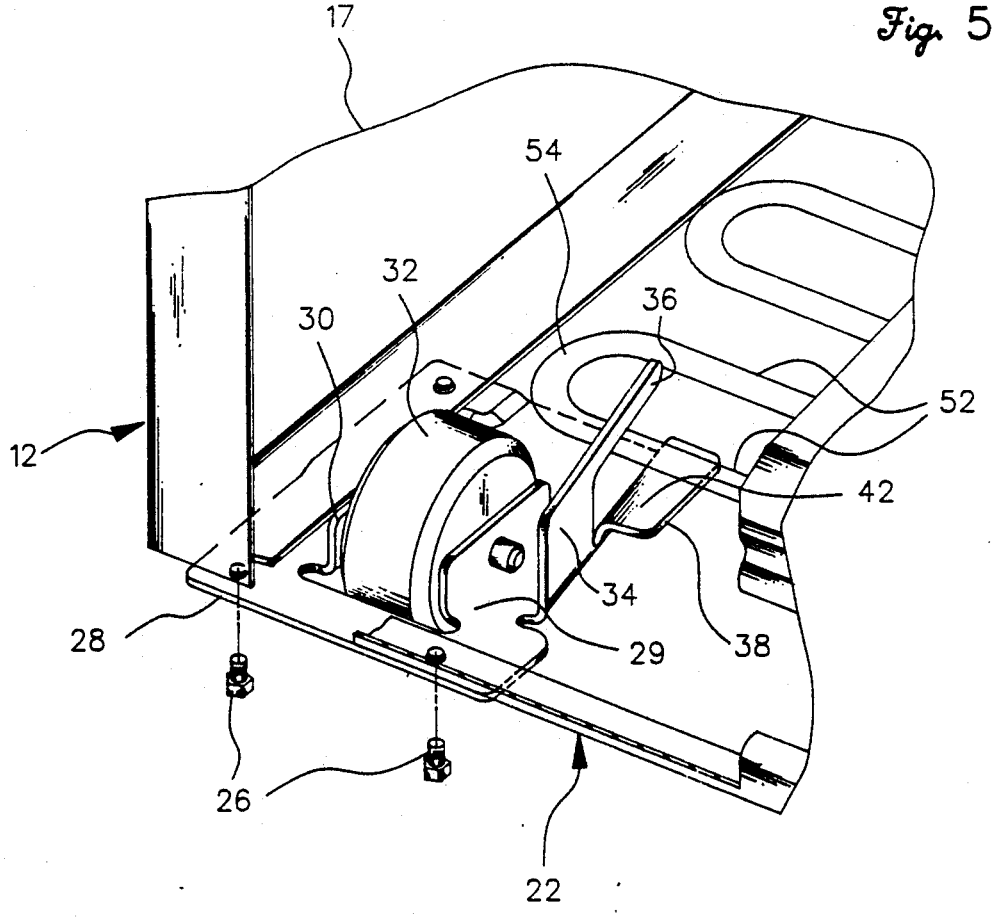
FIG. 5 is an enlarged, fragmentary perspective view of the lower left front corner of the refrigerator of FIG. 1, illustrating part of the support for the condenser.

As best seen in FIGS. 1, 4 and 5, a pair of support members or rails 22 and 24 Join the front and rear edges respectively of the side panels 15 and 17. These rails are attached to the case by any suitable means such as screws 26. Referring now to FIGS. 1 and 5, it will be seen that a bracket 28 is attached to the lower left front corner of the refrigerator, particularly the front rail 22 and bottom edge of the outer case 12 and includes bearing support walls 29 and 30 on which a roller or wheel 32 is rotationally mounted in order to movably support the left front corner of the refrigerator. The bracket 28 is formed with a flange 34 which extends rearwardly into the machinery compartment 20 and is formed with upper and lower fingers 36 and 38 respectively, which are spaced apart in the rearward direction as seen at 40. The finger 38 is formed with a horizontal platform or support pad 42. It will be understood that a similar bracket is provided at the right front lower corner of the refrigerator and that additional rollers or wheels are mounted adjacent the rear corners of the refrigerator so that it may be easily moved when desired.

Figure 2:
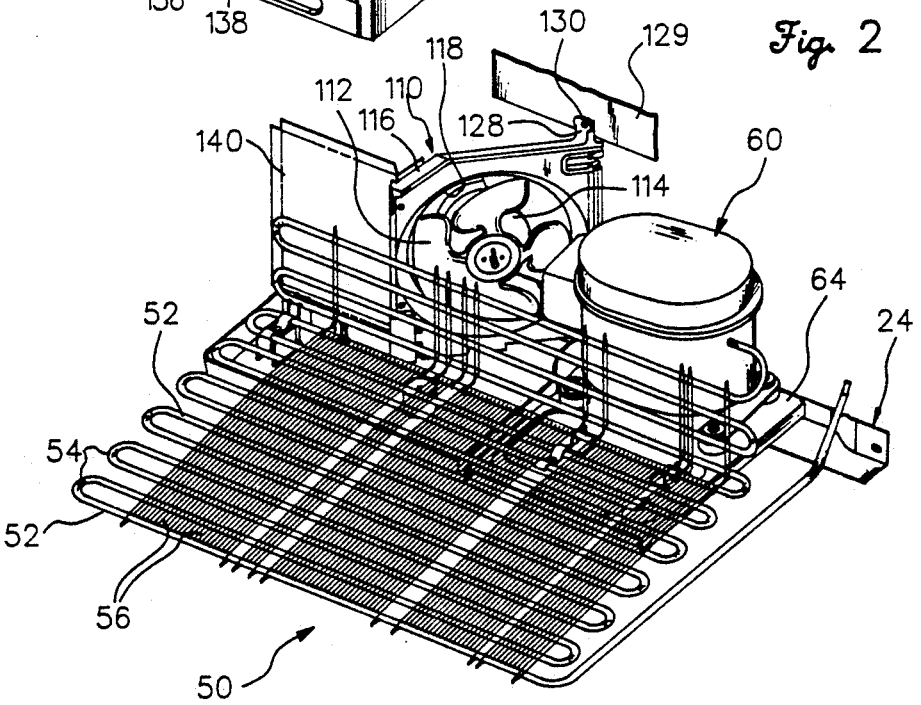
FIG. 2 is a simplified top perspective view of the high side equipment assembly of the refrigerator of FIG. 1.
Figure 3:
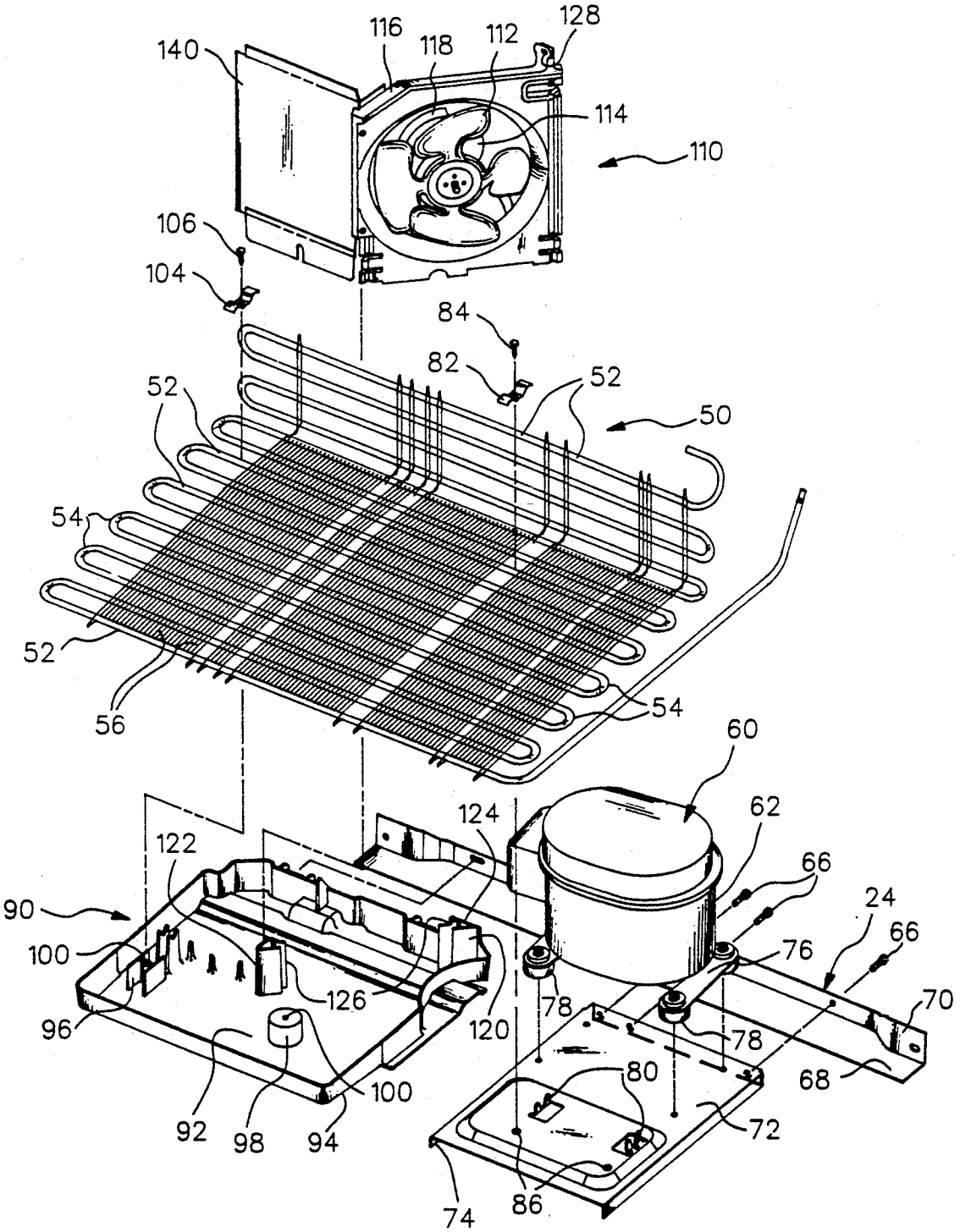
FIG. 3 is an exploded view of the assembly of FIG. 2.

Referring now to FIGS. 2, 3 and 4, the high side system includes a condenser 50 and compressor 60. The condenser 50 is formed from an elongated tube bent into a serpentine configuration so that it has a number of straight runs 52, which extend from side to side across the machinery compartment, Joined by end turns 54. A number of wires or ribs 56 extend at right angles to the runs 52 and are structurally joined to the tube by some suitable process, such as brazing or welding, for example. Thus, the reinforcing ribs 56 provide structural rigidity and strength to the condenser structure as well as additional surface area for enhanced heat transfer from the condenser. As seen in FIG. 5, the condenser is mounted in the machinery compartment with at least the forward run 52 of tubing received between the fingers 36 and 38 of the roller brackets, and resting on the support pad 42. The condenser extends rearwardly through most of the front to back length or depth of the machinery compartment 24.

The compressor 60 may be a typical motor-compressor in which the motor for driving the compressor is contained within the hermetically sealed compressor or housing 62. A compressor mounting structure or support frame 64 is received in the machinery compartment and is structurally connected to the rear support member or rail 24 by suitable means such as screws 66. More specifically, the rail 24 includes a horizontally disposed flange 68 and a vertically disposed flange 70. The mounting structure 64 rests upon the horizontal flange 68 and is drawn tightly against the vertical flange 70 by the screws 66. The illustrative mounting structure 64 includes a horizontally disposed plate portion 72 with depending flanges 74 and conveniently is formed from a suitable structural material such as steel. The compressor 60 is mounted on the portion of the plate 72 closest to the supporting rail 24 by means of a bracket 76 and resilient cushions 78. As is well known in the art, screws are inserted through the bracket 76 and cushions 78 and threadedly received in the plate portion 72. Alternatively, other means, such as bolts and nuts, for example, may be used for the attachment.

The mounting structure or support frame 64 extends forwardly from the rear rail 24 so that a portion of the plate 72 forward of the compressor 60 is in overlapping relationship with the rear portion of the condenser 50 and, more specifically, in the illustrative embodiment the plate 72 extends under the condenser 50. The plate 72 is provided with two pairs of spaced apart fingers 80. When the plate 72 and condenser 50 are in appropriate overlapping relationship, they are brought vertically together so that each pair of fingers 80 spans and grips one of the straight runs 52 of condenser tubing. Then brackets or clips 82 are placed against the upper side of the condenser tubing so that each bracket spans at least two straight condenser tubing runs and screws 84 pass through the brackets and are threadedly received in the plate 72 to complete the structural connection between the mounting structure 64 and condenser 50. While only one bracket and screw combination has been illustrated, it will be apparent that more than one can be utilized, and, in the illustrative embodiment there are two, as indicated by the screw receiving openings 86 in the plate 72.

With the high side assembly as thus far described, the condenser and the support frame for the compressor are firmly and intimately interconnected so that the combined structure is supported from the front and rear rails without the necessity of any separate support structure extending between the front and rear rails or any connecting members being attached to other portions of the cabinet.

It is common practice in modern day refrigerators to provide a self-defrosting feature by which, from time to time, the frost build up on the evaporator is melted and the condensate is directed to the outside of the refrigerated compartments. Typically this condensate is collected in a pan or similar container in the machinery compartment so that the heat in this compartment and the air flowing through the compartment will evaporate the water.

The condensate collection container or pan 90 is molded from a suitable material like polypropylene and includes an imperforate bottom wall 92 and an upstanding peripheral side wall 94, providing a contained space to receive condensate water resulting from defrost operations of the refrigerator. Condenser attachment posts 96 and 98 extend upwardly from the bottom wall 92 and include openings or weakened areas 100 to receive screws. The condensate container 90 rests upon the horizontal flange 68 of rear rail 24 and is connected to the vertical flange 70 of the rail by clips (not shown) which are received in slots 102 in flange 70. With the container in this position the condenser 50 is positioned adjacent the support posts or members 96 and 98. A bracket or clip 104 is placed against the upper side of the condenser spanning a pair of adjacent straight runs 52 and is secured against the condenser by means of a screw 106 which passes through the clip and is threadedly received in the opening 100 of support post 96. A similar bracket and screw are used with the support post 98, but have been omitted from the drawing for the sake of simplicity.

In order to cause cooling air to flow across the condenser and compressor and across the collection pan 90, a fan or blower mechanism 110 is provided. Typically such mechanisms include a fan or blower blade 112 and motor 114 mounted to a shroud 116 having a central opening 118. With this construction the shroud directs the air moved by the fan so that it flows through the central opening.

The condensate collection pan 90 includes a pair of integral clips 120 and 122 which form upwardly opening slots 124 and 126 respectively. The fan or blower mechanism 110 is positioned in the machinery compartment with the lower edge of the shroud received in the slots 120 and 126. This orients the fan mechanism so that it causes air to flow across the condenser and the compressor. The upper edge of the shroud includes a tab 128 which is structurally connected to the outer wall 129 by means of a screw 130. This assures correct orientation of the upper part of the shroud 110 and utilizes the shroud to prevent excessive upward movement or flexing of the combined condenser-compressor mounting structure and condensate pan, particularly when the refrigerator is being shipped or moved. Conveniently the shroud is constructed from a structural foam sold by General Electric Company under the trademark NORYL.

As is well known in the art, the lower front edge of the refrigerator case 12 is provided with a panel 136 defining air passages 138 and a deflector 140 is attached to the inner edge of the shroud 110 and extends across the remainder of the rear portion of the machinery compartment. These elements complete the air flow passage and assure that the air moved by the fan mechanism 110 flows across the condenser, the compressor and the condensate collection pan.

While specific embodiments of the present invention have been illustrated and described herein, it is realized that modifications and changes will occur to those skilled in the art. It is therefore to be understood that the appending claims are intended to cover all such modifications and changes as fall within the true spirit and scope of the invention.

What is claimed is:

1. A refrigerator including:

a cabinet having an upper compartment to be refrigerated and a lower machinery compartment, first and second support members extending substantially across said machinery compartment in spaced apart relationship;

a condenser positioned in said machinery compartment and supported from said first support member;

a mounting structure positioned in said machinery compartment and supported from said second support member;

means remote from said support members structurally connecting said condenser and said mounting structure; and a compressor mounted on said mounting structure.

2. A refrigerator as set forth in claim 1, further comprising:

a condensate collection container positioned in said machinery compartment and supported from said second support member;

means remote from said support members structurally connecting said container and said condenser; and a blower mechanism positioned in said machinery compartment and oriented to cause air to blow across said condenser and said compressor.

3. A refrigerator as set forth in claim 2, wherein:

said condensate collection container defines at least one elongated slot therein;

said blower mechanism includes a shroud received in said at least one elongated slot; and means structurally interconnects said shroud to said cabinet.

4. A refrigerator including:

a cabinet having an upper compartment to be refrigerated and a lower machinery compartment;

a first elongated support member extending across the front portion of said machinery compartment and a second elongated support member extending across the rear portion of said machinery compartment;

a condenser supported from said first support member and extending rearwardly in said machinery compartment;

a support frame supported from said second support member and extending forwardly in said machinery compartment in partial overlapping relationship with said condenser;

means structurally connecting the overlapping portions of said condenser and support frame; and a compressor mounted on said support frame.

5. A refrigerator as set forth in claim 4, further including:

a condensate collection container supported from said second support member and extends forwardly in said machinery compartment in partial overlapping relationship with said condenser;

means structurally connecting the overlapping portions of said condenser and condensate container; and a blower mechanism positioned in said machinery compartment and oriented to cause air to flow over said condenser and compressor.

6. A refrigerator as set forth in claim 5 wherein said condensate container defines therein at least one elongated slot;

said blower includes a shroud received in said at least one elongated slot; and means structurally connects said shroud to said cabinet.

7. A refrigerator as set forth in claim 5, further including:

a pair of rollers for supporting the front of the refrigerator;

a pair of mounting brackets connected to said first support member in spaced apart relation$hip and supporting respective ones of said rollers; and each of said brackets supporting said condenser.

8. A refrigerator as set forth in claim 7, wherein: each of said brackets includes a pair of spaced apart fingers open toward the rear of said machinery compartment and said condenser is received between said fingers.

9. A refrigerator as set forth in claim 4, wherein: said means structurally connecting said condenser and support frame is removable.

10. A refrigerator as set forth in claim 4, wherein: said means structurally connecting said condenser and support frame includes at least one bracket interfitting with said condenser and at least one threaded member removably connecting said bracket to and support frame.

* * * * *